US007765939B2

(12) United States Patent
Chen

(10) Patent No.: US 7,765,939 B2
(45) Date of Patent: Aug. 3, 2010

(54) FOLDABLE STAND

(75) Inventor: Jung-Huo Chen, Taichung (TW)

(73) Assignee: Rexon Industrial Corp., Ltd, Taichung (TW)

( * ) Notice: Subject to any disclaimer, the term of this patent is extended or adjusted under 35 U.S.C. 154(b) by 278 days.

(21) Appl. No.: 11/905,207

(22) Filed: Sep. 28, 2007

(65) Prior Publication Data

US 2008/0092786 A1 Apr. 24, 2008

(30) Foreign Application Priority Data

Oct. 19, 2006 (TW) ..... 95138490 A

(51) Int. Cl.
*A47B 3/00* (2006.01)

(52) U.S. Cl. ..... 108/127

(58) Field of Classification Search ..... 108/169, 108/174, 127, 131, 132; 248/166, 170, 439; 211/195

See application file for complete search history.

(56) References Cited

U.S. PATENT DOCUMENTS

| | | | | | |
|---|---|---|---|---|---|
| 161,304 | A | | 3/1875 | Waggoner | |
| 208,912 | A | | 10/1878 | Lambie | |
| 1,120,702 | A | * | 12/1914 | Erdman | 108/115 |
| 1,959,950 | A | * | 5/1934 | Friedlander | 108/90 |
| 2,144,049 | A | * | 1/1939 | Forcier | 182/225 |
| 2,202,318 | A | * | 5/1940 | Ralson | 403/65 |
| 2,291,967 | A | * | 8/1942 | Keahey | 108/127 |
| 2,660,497 | A | * | 11/1953 | Norquist | 108/127 |
| 2,708,145 | A | * | 5/1955 | Anderson et al. | 108/127 |
| 2,879,119 | A | * | 3/1959 | Bullock | 108/132 |
| 2,977,169 | A | * | 3/1961 | Geller | 108/19 |
| 3,669,031 | A | | 6/1972 | Cole | |
| 4,022,414 | A | * | 5/1977 | Egger | 248/150 |
| 4,103,626 | A | * | 8/1978 | Barricks | 108/127 |
| 4,144,822 | A | * | 3/1979 | Roberts et al. | 108/129 |
| 4,833,998 | A | | 5/1989 | Everett et al. | |
| 5,009,170 | A | | 4/1991 | Spehar | |
| 5,524,555 | A | | 6/1996 | Fanuzzi | |
| 5,606,922 | A | * | 3/1997 | Adams et al. | 108/129 |
| 6,360,797 | B1 | | 3/2002 | Brazell et al. | |
| 6,394,005 | B1 | * | 5/2002 | Isensee et al. | 108/132 |
| 6,865,985 | B2 | * | 3/2005 | Zheng | 100/127 |
| 6,942,229 | B2 | | 9/2005 | Brazell et al. | |
| 7,059,616 | B2 | | 6/2006 | Wu | |
| 7,077,421 | B2 | | 7/2006 | Wu | |
| 7,131,364 | B2 | | 11/2006 | Brazell | |

(Continued)

*Primary Examiner*—Janet M Wilkens
*Assistant Examiner*—Dan Rohrhoff
(74) *Attorney, Agent, or Firm*—Bacon & Thomas, PLLC

(57) ABSTRACT

A foldable stand includes a platform for holding a power tool, four legs, and a connecting device set, which has four connecting devices respectively pivotally secure the legs to the platform for allowing the legs to be set between a collapsed status received inside the platform and an extended status to support the platform above the floor. The third and fourth connecting devices are respectively disposed at two opposite sides relative to the connection line that is defined between the first connecting device and the second connecting device. The leg that is coupled to the first connecting device is disposed near the connection line between the first connecting device and the second connecting device and far from the third connecting device, and the leg that is coupled to the second connecting device is disposed near the connection line between the first connecting device and the second connecting device and far from the fourth connecting device.

11 Claims, 6 Drawing Sheets

U.S. PATENT DOCUMENTS 7,213,829 B2 5/2007 Wu
7,222,865 B2 5/2007 Chen et al.
7,418,907 B2 * 9/2008 Haimoff ..... 108/91
2006/0130718 A1 6/2006 Lo et al.

* cited by examiner

FOLDABLE STAND

BACKGROUND

1. Field of the Invention

The present invention relates to support means for use in supporting a power tool, and more particularly, to a foldable stand, which is foldingly collapsible.

2. Description of the Related Art

U.S. Pat. No. 6,607,015 discloses a foldable stand, entitled "Foldable Worktable". According to this design, as shown in FIG. 1, the foldable worktable 10 includes a tabletop 12, two H-shaped legs 14 pivotally attached to a bottom of the tabletop 12, and a plurality of attachment members 16. Each attachment member 16 includes a hook 18 formed on the bottom side of the tabletop 12, a lever 20 pivotally mounted on one side of each of the legs 14, and a U-shaped loop 22 pivotally attached to the lever 20 and selectively mounted over the hook 18. When collapsing the foldable worktable 10, the U-shaped loops 22 are disconnected from the hooks 18, and then the legs 14 are folded inwards. When the foldable worktable 10 is erected into the unfolded configuration, the legs 14 are turned or rotated outwards to a predetermined position, and then the U-shaped loops 22 are pulled downwards via the levers 20 to lock the two legs 14 in the extended position. This operation method is simple and convenient to use.

According to the aforesaid design, the U-shaped loop 22 is made by bending a wire member into shape with its two ends respectively inserted into two sides of the lever 20. When operating the lever 20 is pulled to tighten the U-shaped loop 22 or when the U-shaped loop 22 receives an excessively high pressure, the U-shaped loop 22 may be deformed, and the two ends of the U-shaped loop 22 may escape out of the lever 20, such that the attachment member will lose its function.

FIG. 2 is a side view showing the foldable worktable 10 in a folded and collapsed configuration. When the foldable worktable 10 is collapsed, the bottom ends of the two legs 14 protrude over the periphery of the tabletop 12, and therefore a larger storage space is required for storing the collapsed foldable worktable 10, and the protruding bottom ends of the legs 14 may hinder or catch on other bodies or objects.

SUMMARY

The present embodiments have been accomplished in view of the circumstances described above. Accordingly, the present embodiments provide a foldable stand, which eliminates the drawbacks of the aforesaid prior art design and, which is convenient for storage when in a folded and collapsed configuration.

In view of the above discussion, an embodiment of the foldable stand is comprised of a platform, four legs, and a connecting device set. The platform is adapted to support a power tool. The four legs are for supporting the platform above a floor or other supporting surface at a predetermined height. The connecting device set comprises a first connecting device, a second connecting device, a third connecting device and a fourth connecting device respectively coupled to each of the four legs and respectively affixed to the platform to pivotally secure the legs to the platform for allowing the legs to be turned or rotated relative to the platform between an extended position and a collapsed position. A first connection line is connected between the first connecting device and the second connecting device. The third connecting device is disposed at a first side relative to the first connection line. The fourth connecting device is disposed at a second side relative to the first connection line and opposite to the first side. The leg that is coupled to the first connecting device is disposed outside the second side and near the first connection line and far away from the third connecting device and kept in parallel to the platform when turned toward the platform. The leg that is coupled to the second connecting device is disposed outside the first side and near the first connection line and far away from the fourth connecting device and kept in parallel to the platform when turned toward the platform.

Further, each of the four connecting devices includes a mounting base, a guide mechanism, and a locking mechanism. The mounting base is fixedly fastened to the bottom wall of the platform, comprising an opening and a body surrounding the opening. The guide mechanism comprises a guide track formed in the body of the mounting base and a sliding member fastened to the top end of a respective leg and movable along the first guide track for allowing movement of the top end of the associated leg in the mounting base. The top end of the associated leg is disposed out of the opening when the associated leg is collapsed. The locking mechanism comprises a guide slot vertically formed in the body of the mounting base and extending to the bottom edge of the body of the mounting base, and a lock bolt threaded into the top end of the associated leg and movable with the associated leg in and out of the guide slot.

When the four legs of the foldable stand are extended out, the four legs support the platform above the floor at a predetermined height to hold a power tool in a convenient orientation for operation. When the two legs that are respectively coupled to the first connecting device and the second connecting device are collapsed, they are disposed adjacent to the first connection line and kept within the platform without protruding over the periphery of the platform. Therefore, the collapsed foldable stand is convenient for storage without hindering other external bodies and objects.

Further, each locking mechanism of the foldable stand simply comprises a guide slot and a lock bolt. This arrangement is simpler, cheaper, and more durable when compared to the U-shaped loop type locking arrangement of the aforesaid prior art design.

DETAILED DESCRIPTION OF VARIOUS EMBODIMENTS

Figure 1:
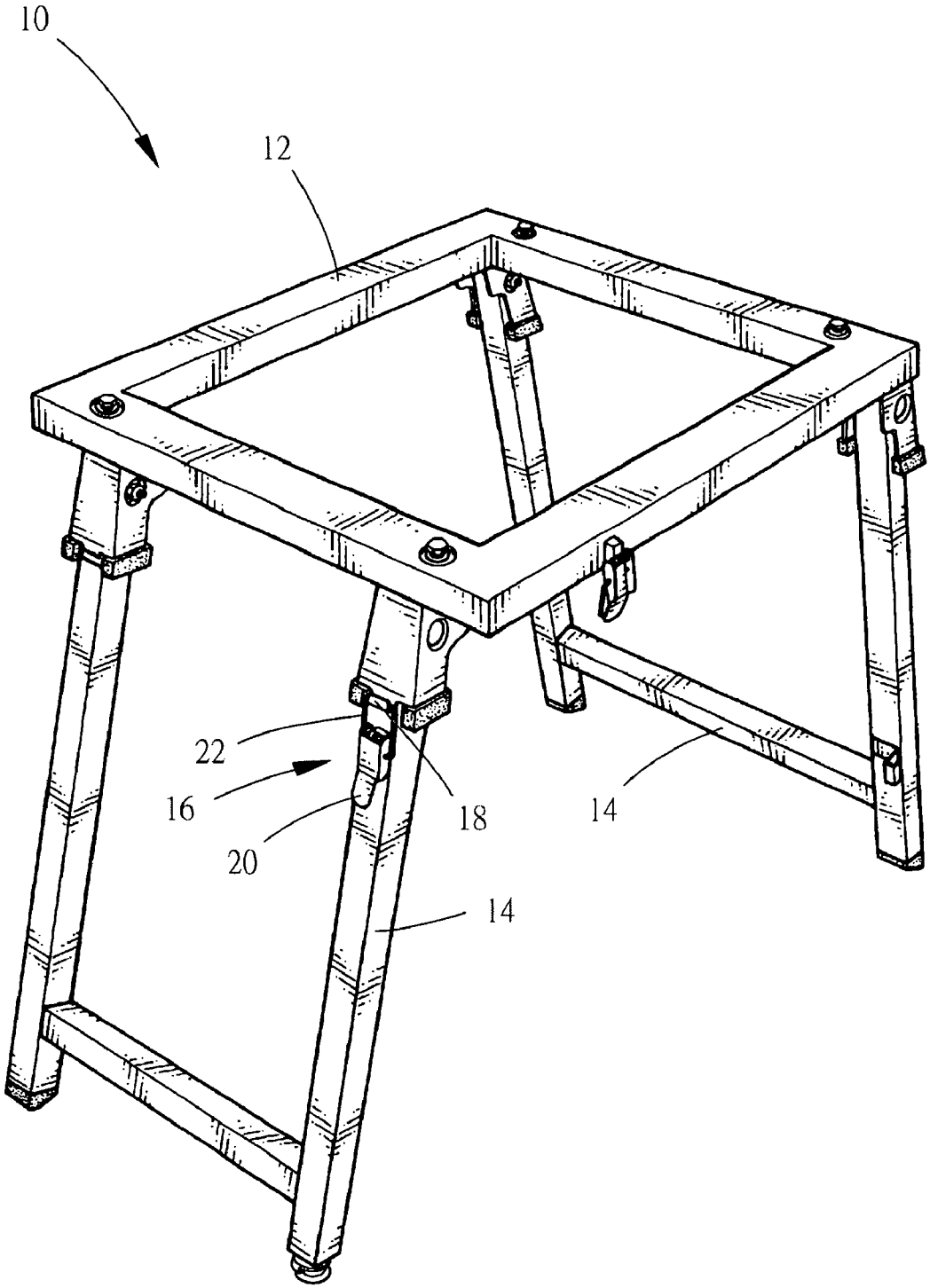
FIG. 1 PRIOR ART
FIG. 1 is an elevational view of a stand in an extended, unfolded status according to the prior art.
Figure 2:
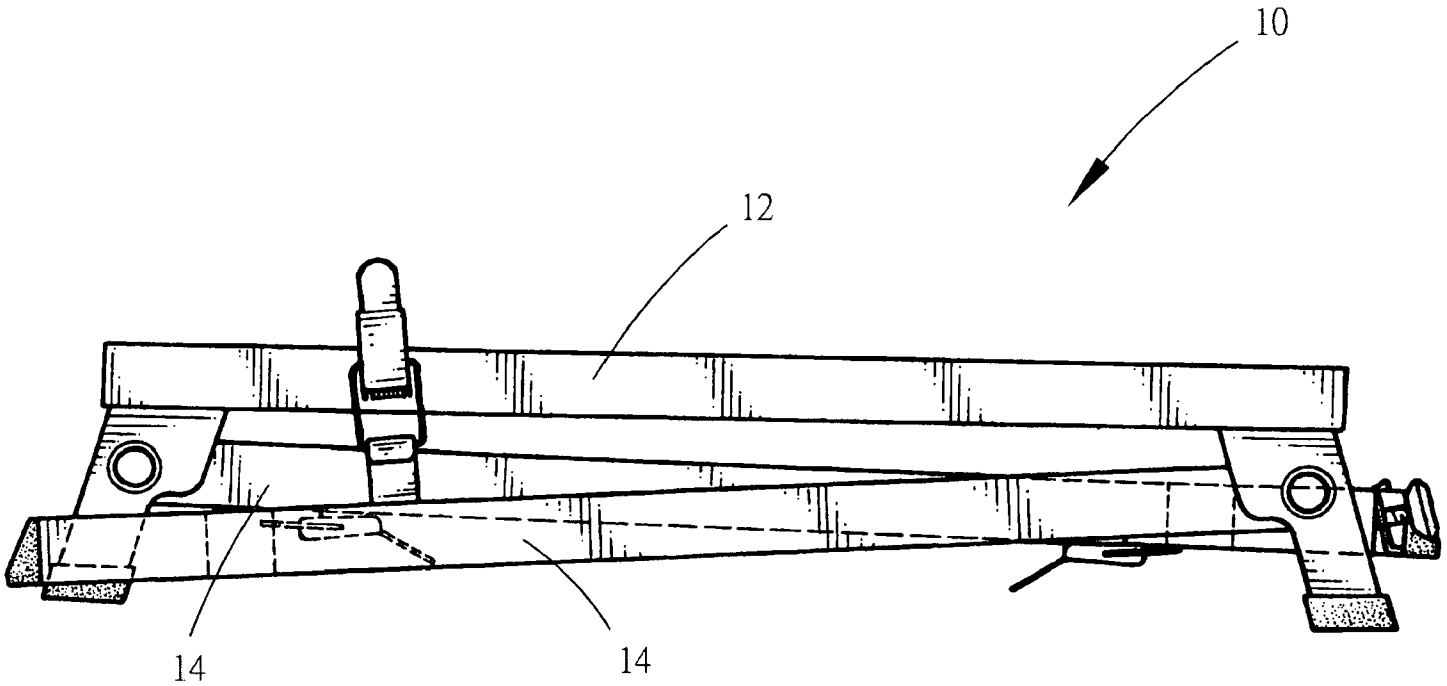
FIG. 2 PRIOR ART
FIG. 2 is a schematic side view showing the prior art stand in a folded, collapsed configuration.
Figure 3:
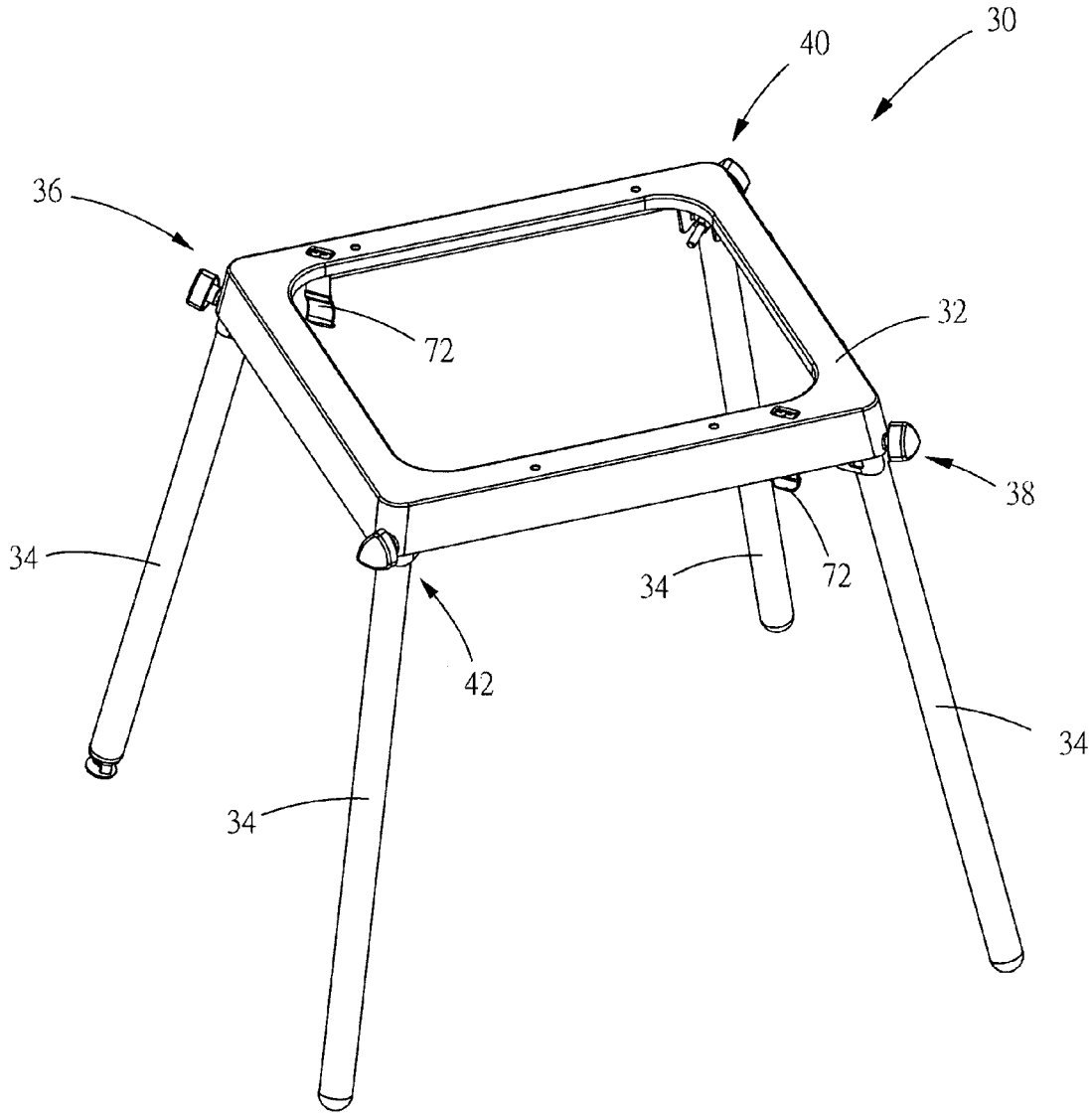
FIG. 3 is an oblique top elevation view of a foldable stand in an extended, unfolded status according to a first embodiment.
Figure 4:
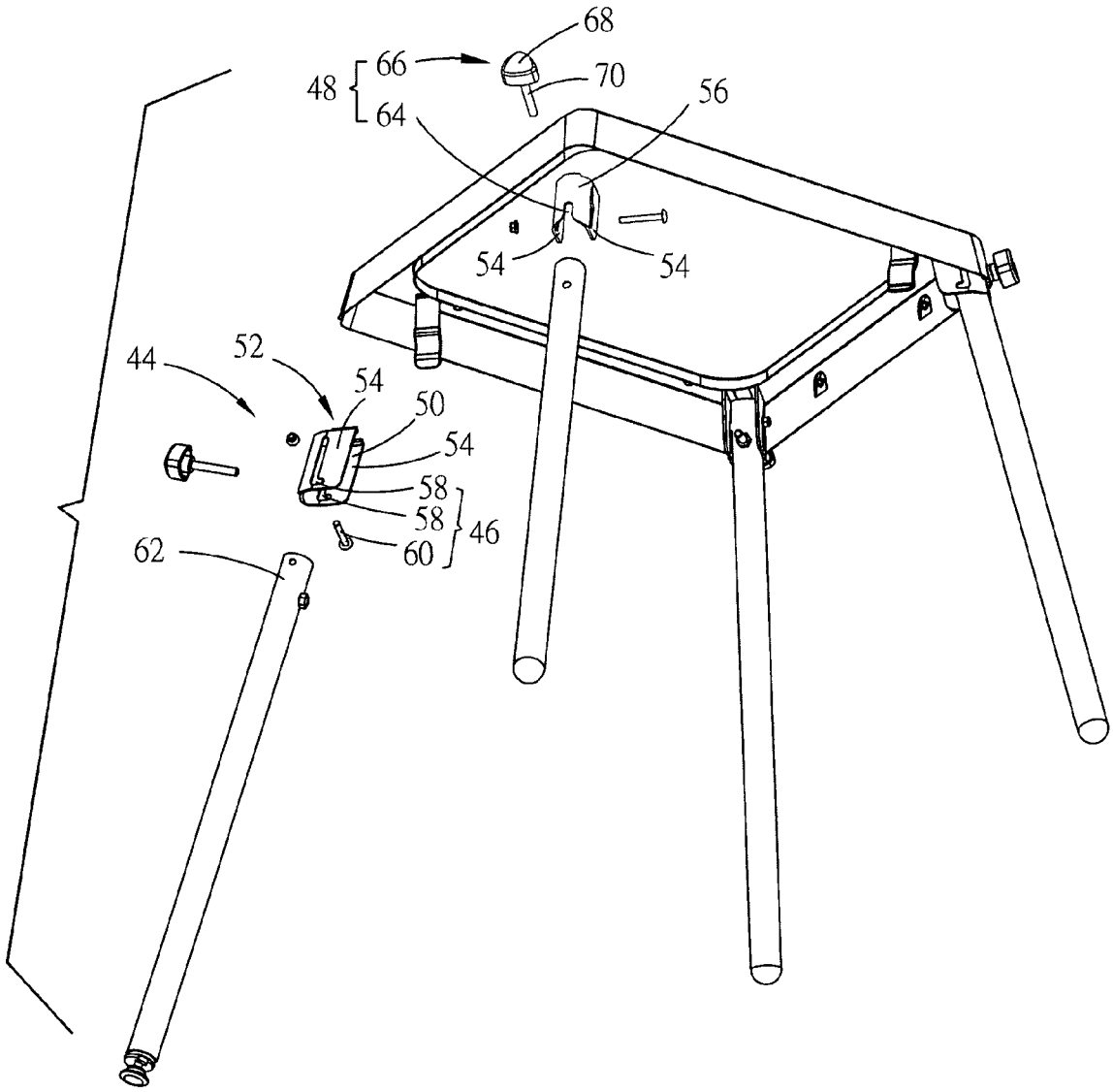
FIG. 4 is an exploded view of the foldable stand of FIG. 3.

Referring to FIGS. 3 and 4, a foldable stand 30 in accordance with the present disclosure is adapted to support a power tool such as table saw, miter saw, scroll saw, band saw, power drill, sander, planer, cut-off saw, etc. The foldable stand 30 is comprised of a platform 32, four legs 34, and a connecting device set. The platform 32 is adapted to support a power tool. The platform 32 can be a circular flat panel, rectangular flat panel, rectangular frame, or any of a variety of other configurations. According to this embodiment, the platform 32 is a rectangular frame. The four legs 34 are round rod members respectively arranged in the four corners at the bottom side of the platform 32. When the four legs 34 are extended out, they support the platform 32 above the floor to hold the power tool at a predetermined elevation above the floor for convenient operation by the user.

Referring to FIGS. 3 and 4 again, the aforesaid connecting device set comprises a first connecting device 36, a second connecting device 38, a third connecting device 40, and a fourth connecting device 42. The four connecting devices 36, 38, 40, 42 are respectively provided in the four corners of the platform 32, each comprising a mounting base 44, a guide mechanism 46, and a locking mechanism 48. The mounting base 44 is fixedly mounted in one corner of the platform 32 at the bottom side of the platform 32, and defines an opening 50 and a body 52 surrounding the opening 50. The body 52 comprises two sidewalls 54 arranged at two sides of the opening 50, and a bottom wall 56 facing the opening 50 and connected between the two sidewalls 54. The guide mechanism 46 comprises a guide track or rail 58 and a sliding member 60 movable along the guide rail 58. The guide track 58 is provided at one sidewall 54 of the mounting base 44 corresponding to the top end 62 of the associated leg 34. According to this embodiment, the guide track 58 is a sliding slot cut through one sidewall 54 of the body 52. The sliding member 60 according to this embodiment is a bolt inserted through the top end 62 of the associated leg 34 and into the sliding slot (guide track) 58, and is movable with the associated leg 34 along the sliding slot (the guide track) 58. Alternatively, the guide mechanism 46 can be made comprising two guide tracks (sliding slots) 58 respectively formed in the two sidewalls 54 of the body 52, and two bolts (sliding members) 60 inserted through the two guide tracks (sliding slots) 58 and the top end 62 of the associated leg 34 to guide movement of the top end 62 of the associated leg 34 along the guide tracks (sliding slots) 58. The locking mechanism 48 comprises a guide slot 64 vertically cut through the bottom wall 56 of the mounting base 44 and extending to the bottom edge of the bottom wall 56, and a lock bolt 66, which has a head 68 and a threaded body 70 threaded into the top end 62 of the associated leg 34. Moving the top end 62 of the associated leg in the mounting base 44 causes the threaded body 70 to be forced into or out of the guide slot 64. When the leg 34 is in the extended configuration, the threaded body 70 is forced into the guide slot 64, at this time the user can rotate the head 68 to thread the threaded body 70 into the top end 62 of the associated leg 34 such that the head 68 can be stopped against the bottom wall 56 of the mounting base 44, thereby locking the associated leg 34 to the mounting base 44.

Figure 5:
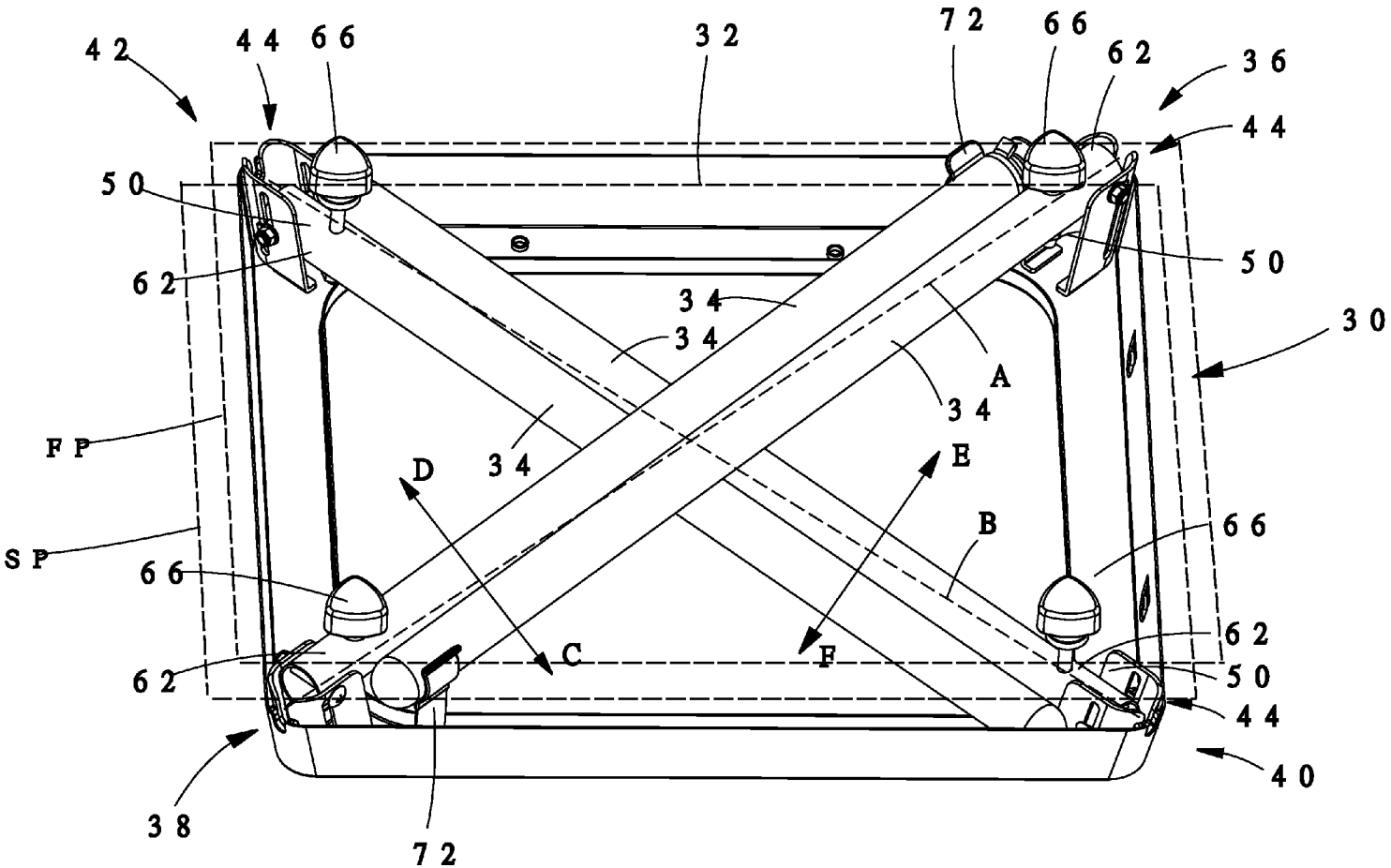
FIG. 5 is a perspective bottom view of the foldable stand of FIG. 3, showing the folded, collapsed status of the foldable stand.

Referring to FIG. 5, when collapsing the stand 30 to the folded and collapsed configuration, the guide mechanisms 46 of the four connecting devices 36, 38, 40, 42 and the four legs 34 are respectively moved in the respective mounting bases 44 to carry the lock bolts 66 of the associated locking mechanisms 48 out of the associated guide slots 64. At this time, the four legs 34 are turned inwards and into close contact with the bottom side of the platform 32 to move the respective top ends 62 out of the openings 50 of the mounting bases 44. When collapsed, the four legs 34 are received inside the platform 32, and the extending direction of the four folded legs 34 is about in parallel to the platform 32. Further, a first connection line A is defined connected between the first connecting device 36 and the second connecting device 38, and a second connection line B is defined connected between the third connecting device 40 and the fourth connecting device 42. As the platform 32 has a rectangular shape, the two connection lines A and B correspond to the two diagonal lines of the platform 32 in equal length. The length of each leg 34 is shorter than the diagonal lines of the platform 32 but greater than each long side of the platform 32. Further, the third connecting device 40 is disposed on one side relative to the first connection line A, namely the first side C; the fourth connecting device 42 is disposed at an opposite side relative to the first connection line A, namely, the second side D opposite to the first side C; the first connecting device 36 is disposed at one side relative to the second connection line B, namely, the third side E and the second connecting device 38 is disposed at an opposite side relative to the second connection line B, namely, the fourth side F opposite to the third side E. Because the length of each leg 34 is shorter than the first connection line A and the second connection line B but greater than the long sides of the platform 32, the four legs 34 do not protrude over the periphery of the platform 32 when the foldable stand 30 is in the folded, collapsed configuration. When turning the leg 34 that is coupled to the first connecting device 36 to the position where its length is kept in substantially parallel to the platform 32, the leg 34 is in the collapsed status and biased to the first side C near the first connection line A and far away from the third connecting device 40; when turning the leg 34 that is coupled to the second connecting device 38 to the position where its length is kept in substantially parallel to the platform 32, the leg 34 is in the collapsed status and biased to the second side D near the first connection line A and far away from the fourth connecting device 42; when turning the leg 34 that is coupled to the third connecting device 40 to the position where its length is kept in substantially parallel to the platform 32, the leg 34 is in the collapsed status and biased to the third side E near the second connection line B and far away from the first connecting device 36; when turning the leg 34 that is coupled to the fourth connecting device 42 to the position where its length is kept in substantially parallel to the platform 32, the leg 34 is in the collapsed status and biased to the fourth side F near the second connection line B and far away from the second connecting device 38.

In addition to the aforesaid improvements, the present embodiment has considered the length positioning of the four legs 34 and the arrangement of the foldable stand 30 during collapsing. According to the present embodiment, the two legs 34 that are respectively coupled to the connecting devices at the two diagonal corners can be made relatively longer if they can be set more closely to the connection line that connects the respective two connecting devices. According to this embodiment, the two legs 34 that are respectively coupled to the first connecting device 36 and the second connecting device 38 are set close to each other to constitute a first plane and the two legs 34 that are respectively coupled to the third connecting device 40 and the fourth connecting device 42 are set close to each other to constitute a second plane when the foldable stand 30 is collapsed. The first plane and the second plane are substantially in parallel to the platform 34. Further, the two legs 34 that are respectively coupled the third connecting device 40 and the fourth connecting device 42 are stacked on the other two legs 34. Further, the platform 32 has two downwardly suspending retaining lugs 72. The first one of the two legs 34 that are respectively coupled to the first connecting device 36 and the second connecting device 38 is firmly stopped between one retaining lug 72 and the second one of the two legs 34 that are respectively coupled to the first connecting device 36 and the second connecting device 38 is firmly stopped between the other retaining lug 72 and the first one of the two legs 34 that are respectively coupled to the first connecting device 36. Thus, the four legs 34 are firmly held in position when collapsed, and the four lock bolts 66 are thus adjusted for supporting the platform 32, via the heads 68, above the floor stably while in the collapsed position.

Figure 6:
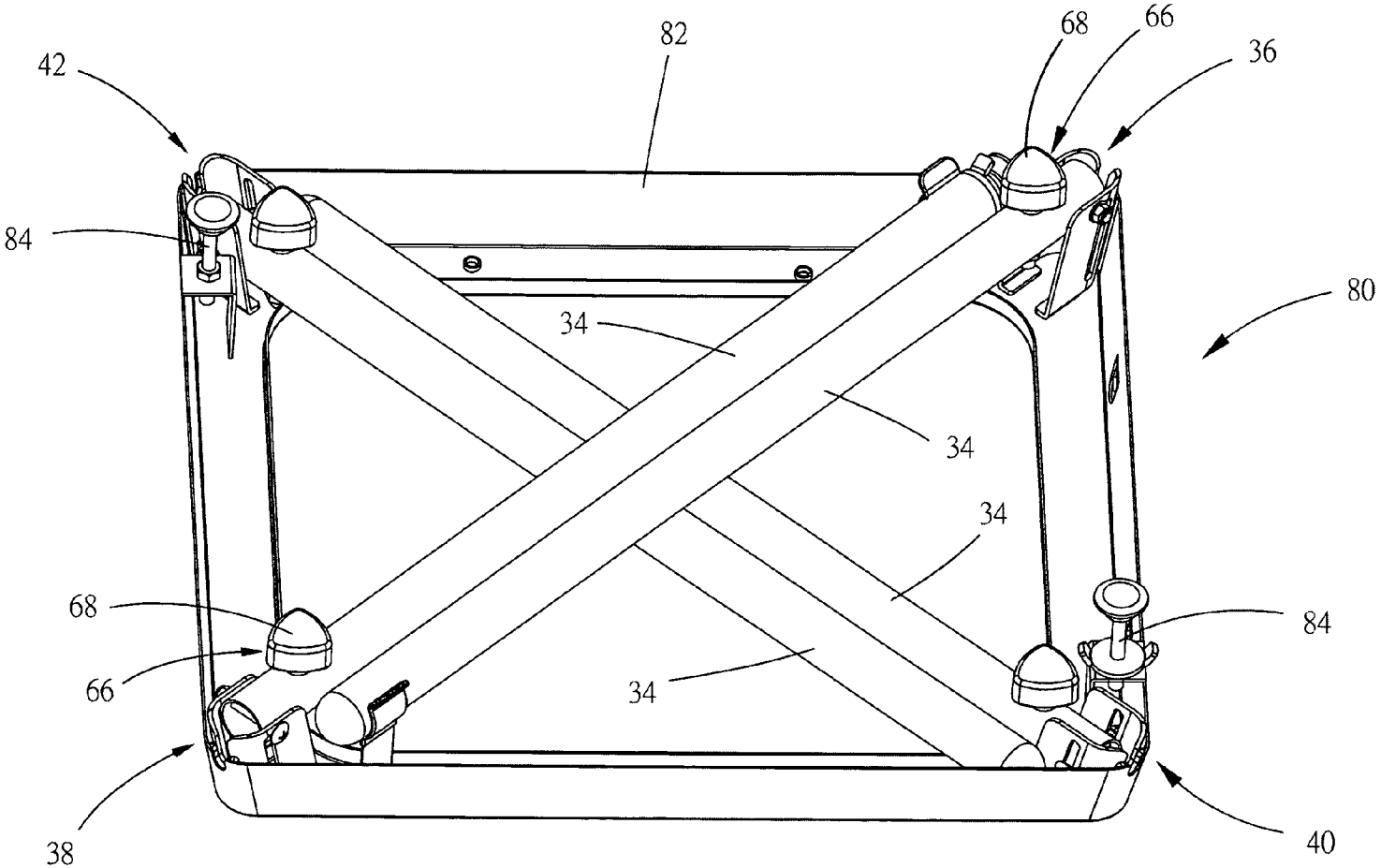
FIG. 6 is a perspective bottom view showing the folded, collapsed status of an alternate form of the foldable stand.

FIG. 6 illustrates the folded and collapsed status of a foldable stand 80 in accordance with another embodiment. The component parts of this embodiment are substantially similar to the foldable stand 30 of the aforesaid first embodiment with the exception that the platform 82 of the foldable stand 80 of this second embodiment has two downwardly extending rod members 84. The two rod members 84 are respectively disposed near the third connecting device 40 and the fourth connecting device 42. When the four legs 34 are collapsed, the rod members 84 and the two lock bolts 66 support the platform 82, via the heads 68, above the floor stably while in the collapsed position.

As stated above, when the four legs 34 of the foldable stand 30 or 80 are extended out, the four legs 34 support the platform 32 or 82 above the floor at a predetermined height to hold a power tool above the floor convenient for operation. When the four legs 34 are collapsed, the two legs 34 in the two diagonal corners are disposed near the connection line that connects the two associated connecting devices and their length is shorter than the associated connection line but greater than the long sides of the rectangular platform 32 or 82. Therefore, the four legs 34 are kept inside the platform 32 or 82 when the foldable stand 30 or 80 is folded and collapsed, and the collapsed foldable stand 30 or 80 is thus more convenient for storage in a smaller space. Further, the two legs 34 that are respectively coupled to the third connecting device 40 and the fourth connecting device 42 are abutted against each other, and the two legs 34 that are respectively coupled to the first connecting device 36 and the second connecting device 38 are abutted against each other and arranged at the bottom side of the other two legs 34. This arrangement allows the legs 34 to be made as long as possible. Matching with the two retaining lugs 72, the legs 34 can be firmly secured in place when the foldable stand 30 or 80 is collapsed. When the foldable stand 30 or 80 is in the collapsed condition, the lock bolts 66 are adjusted to keep the heads 68 of the lock bolts 66 on one same plane for supporting the collapsed foldable stand 30 or 80 on the floor. Alternatively, the two lock bolts 66 corresponding to the two legs 34 at the first connecting device 36 and the second connecting device 38 and the two rod members 84 can be used to support the collapsed foldable stand 30 or 80 on the floor. Further, each locking mechanism 48 of the foldable stand 30 or 80 simply comprises a guide slot 64 and a lock bolt 66. This arrangement is simpler, cheaper, and more durable when compared to the U-shaped loop type locking arrangement of the aforesaid prior art design.

A prototype of a foldable stand has been constructed with the features of FIGS. 3~6. The foldable stand functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A foldable stand, comprising:

a platform;

four legs arranged for supporting said platform above a floor at a predetermined height; and a connecting device set, said connecting device set including;

a first connecting device, a second connecting device, a third connecting device and a fourth connecting device each individually coupled to only one of said legs and affixed to said platform to pivotally secure said legs to said platform for allowing said legs to be turned relative to said platform between an extended position, wherein the extended legs support the platform above the floor, and a collapsed position adjacent the platform; and a first connection line defined between said first connecting device and said second connecting device, said third connecting device being disposed at a first side relative to said first connection line, said fourth connecting device being disposed at a second side relative to said first connection line and opposite to said first side;

the leg coupled to said first connecting device being disposed outside said second side and located adjacent said first connection line spaced from said third connecting device and maintained in parallel to said platform when turned toward said platform;

the leg coupled to said second connecting device being disposed outside said first side and located adjacent said first connection line spaced from said fourth connecting device and maintained in parallel to said platform when turned toward said platform;

wherein the two legs respectively coupled to said first connecting device and said second connecting device constitute a plane in parallel to said platform when collapsed;

first, second, third, and fourth lock bolts associated with said first connecting device, said second connecting device, said third connecting device, and said fourth connecting device to support said platform above the floor, wherein the first, second, third, and fourth lock bolts associated with the first, second, third, and fourth connecting devices extend from the respective legs coupled thereto, such that when the legs are in the collapsed position, the first and second lock bolts are positioned at a first height with respect to the platform and the third and fourth lock bolts are positioned at a second height, shorter than the first height, with respect to the platform; and wherein said platform comprises two rod members respectively disposed adjacent to the third and fourth connecting devices and extending from the platform to a third height that is the same as the first height for cooperating with said first lock bolt and said second lock bolt to stably support said platform above the floor when said legs are collapsed.

2. The foldable stand as claimed in claim 1, wherein said platform comprises two downwardly suspended retaining lugs arranged such that a first one of the two legs respectively coupled to said first connecting device and said second connecting device is retained between one of said retaining lugs and a second one of the two legs respectively coupled to said first connecting device and said second connecting device.

3. The foldable stand as claimed in claim 1, wherein said platform has a rectangular shape, and said legs have a length shorter than each diagonal line connecting the corners of said platform and greater than two opposite long sides of said platform.

4. The foldable stand as claimed in claim 1, wherein a second connection line is defined between said third connecting device and said fourth connecting device, said first connecting device is disposed at a third side that is located at one side relative to said second connection line, said second connecting device is disposed at a fourth side that is located at one side relative to said second connection line and opposite to said third side; the leg that is coupled to said third connecting device is maintained in parallel to said platform and outside said fourth side and adjacent to said second connection line and spaced from said first connecting device when collapsed; the leg that is coupled to said fourth connecting device is maintained in parallel to said platform and outside said third side and adjacent to said second connection line and spaced from said second connecting device when collapsed.

5. The foldable stand as claimed in claim 1, wherein said first connecting device comprises:

a first mounting base fixedly fastened to a bottom wall of said platform, said first mounting base defining a first opening, and having a first body surrounding said first opening; and a first guide mechanism, said first guide mechanism defining a first guide track formed in said first body of said first mounting base, and having a first sliding member fastened to a top end of one of said legs and movable along said first guide track for allowing movement of the top end of the associated leg in said first mounting base, the top end of the associated leg extending from said first opening when the associated leg is collapsed.

6. The foldable stand as claimed in claim 5, wherein said first guide track is a sliding slot formed in said first body of said first mounting base, and said first sliding member is a bolt inserted through said first guide track and the top end of the associated leg.

7. The foldable stand as claimed in claim 5, wherein said first connecting device further comprises a first locking mechanism, said first locking mechanism defining a first guide slot vertically formed in said first body of said first mounting base and extending to a bottom edge of said first body of said first mounting base, and having the first lock bolt threaded into the top end of the associated leg and movable with the associated leg in and out of said first guide slot.

8. The foldable stand as claimed in claim 7, wherein said second connecting device comprises:

a second mounting base fixedly fastened to a bottom wall of said platform, said second mounting base defining a second opening, and having a second body surrounding said second opening;

a second guide mechanism, said second guide mechanism defining a second guide track formed in said second body of said second mounting base, and having a second sliding member fastened to a top end of one of said legs and movable along said second guide track for allowing movement of the top end of the associated leg in said second mounting base, the top end of the associated leg being disposed out of said second opening when the associated leg is collapsed; and a second locking mechanism, said second locking mechanism defining a second guide slot vertically formed in said second body of said second mounting base and extending to a bottom edge of said second body of said second mounting base, and having the second lock bolt threaded into the top end of the associated leg and movable with the associated leg in and out of said second guide slot.

9. A foldable stand, comprising:

a platform;

four legs arranged for supporting said platform above a floor at a predetermined height; and a connecting device set, said connecting device set including:

a first connecting device, a second connecting device, a third connecting device and a fourth connecting device each individually coupled to only one of said legs and respectively affixed to said platform to pivotally secure said legs to said platform for allowing said legs to be turned relative to said platform between an extended position, wherein the extended legs support the platform above the floor, and a collapsed position adjacent the platform; and a first connection line defined between said first connecting device and said second connecting device, said third connecting device being disposed at a first side relative to said first connection line, said fourth connecting device being disposed at a second side relative to said first connection line and opposite to said first side;

the leg coupled to said first connecting device being disposed outside said second side and located adjacent said first connection line spaced from said third connecting device and maintained in parallel to said platform when turned toward said platform; and the leg coupled to said second connecting device being disposed outside said first side and located adjacent said first connection line spaced from said fourth connecting device and maintained in parallel to said platform when turned toward said platform;

wherein said first connecting device, said second connecting device, said third connecting device and said fourth connecting device each comprises:

a mounting base fixedly fastened to a bottom wall of said platform, said mounting base defining an opening, and having a body surrounding said opening;

a guide mechanism, said guide mechanism defining a guide track formed in said body of said mounting base, and having a sliding member fastened to a top end of one of said legs and movable along said guide track for allowing movement of the top end of the associated leg in said mounting base, the top end of the associated leg extending from said opening when the associated leg is collapsed; and a locking mechanism, said locking mechanism defining a guide slot vertically formed in said body of said mounting base and extending to a bottom edge of said body of said mounting base, and having a lock bolt threaded into the top end of the associated leg and movable with the associated leg in and out of said guide slot;

wherein said first connecting device and said second connecting device constitute a first plane in parallel to said platform and said third connecting device and said fourth connecting device constitute a second plane in parallel to said platform when said four legs are collapsed such that the two legs that are respectively coupled to the first and second connecting devices lie in the first plane and the two legs that are respectively coupled to the third and fourth connecting devices lie in the second plane; and four lock bolts associated with the locking mechanisms of said first connecting device, said second connecting device, said third connecting device and said fourth connecting device are adjusted to support said platform above the floor, wherein when the legs are collapsed, the lock bolts associated with the first and second locking mechanism extend a first height from the respective legs coupled thereto, and the lock bolts associated with the third and fourth locking mechanism extend a second height, greater than the first height, from the respective legs coupled thereto such that the four lock bolts are all at the same height relative to the platform for stably supporting the platform above the floor.

10. The foldable stand as claimed in claim 9, wherein a second connection line is defined between said third connecting device and said fourth connecting device;

said first connecting device is disposed at a third side that is located at one side relative to said second connection line;

said second connecting device is disposed at a fourth side that is located at one side relative to said second connection line and opposite to said third side, the leg coupled to said third connecting device being kept outside said fourth side and located adjacent said second connection line spaced from said first connecting device and maintained in parallel to said platform when collapsed, the leg coupled to said fourth connecting device being kept outside said third side and located adjacent said second connection line spaced from said second connecting device and maintained in parallel to said platform when collapsed.

11. A foldable stand, comprising:

a rectangular platform;

four legs for supporting said platform above a floor at a predetermined height; and a connecting device set, said connecting device set including:

a first connecting device, a second connecting device, a third connecting device and a fourth connecting device each individually coupled to only one of said legs and respectively affixed to said platform to pivotally secure said legs to said platform for allowing said legs to be turned relative to said platform between an extended position, wherein the extended legs support the platform above the floor, and a collapsed position adjacent the platform;

a first connection line defined between said first connecting device and said second connecting device, and a second connection line defined between said third connecting device and said fourth connecting device, said third connecting device being disposed at a first side located at one side relative to said first connection line, said fourth connecting device being disposed at a second side located at one side relative to said first connection line and opposite to said first side, said first connecting device being disposed at a third side located at one side relative to said second connection line, said second connecting device being disposed at a fourth side located at one side relative to second connection line and opposite to said third side;

the leg coupled to said first connecting device being disposed outside said second side and located near said first connection line away from said third connecting device and maintained in parallel to said platform when turned toward said platform;

the leg coupled to said second connecting device being disposed outside said first side and located near said first connection line away from said fourth connecting device and maintained in parallel to said platform when turned toward said platform;

the leg coupled to said third connecting device being disposed outside said fourth side and located near said second connection line away from said first connecting device and maintained in parallel to said platform when turned toward said platform;

the leg coupled to said fourth connecting device being disposed outside said third side and located near said second connection line away from said second connecting device and maintained in parallel to said platform when turned toward said platform;

wherein said first connecting device and said second connecting device constitute a first plane in parallel to said platform and said third connecting device and said fourth connecting device constitute a second plane in parallel to said platform when said four legs are collapsed such that the two legs that are respectively coupled to the first and second connecting devices lie in the first plane and the two legs that are respectively coupled to the third and fourth connecting devices lie in the second plane; and four lock bolts associated with locking mechanisms of said first connecting device, said second connecting device, said third connecting device and said fourth connecting device are adjusted to support said platform above the floor, wherein when the legs are collapsed, the lock bolts associated with the first and second locking mechanism extend a first height from the respective legs coupled thereto, and the lock bolts associated with the third and fourth locking mechanism extend a second height, greater than the first height, from the respective legs coupled thereto such that the four lock bolts are all at the same height relative to the platform for stably supporting the platform above the floor.

* * * * *